US011333367B2

(12) United States Patent
Parks et al.

(10) Patent No.: US 11,333,367 B2
(45) Date of Patent: May 17, 2022

(54) HVACR SYSTEM INCLUDING MULTI-POSITIONAL AND MULTI-USE PLENUM FANS

(71) Applicant: TRANE INTERNATIONAL INC., Davidson, NC (US)

(72) Inventors: Jason William Parks, Clarksville, TN (US); Nathan Wagers, Panama City, FL (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/975,398

(22) Filed: May 9, 2018

(65) Prior Publication Data

US 2019/0346156 A1 Nov. 14, 2019

(51) Int. Cl.

| | |
|---|---|
| ***F24F 1/0033*** | (2019.01) |
| ***F24F 1/0059*** | (2019.01) |
| ***F24F 1/02*** | (2019.01) |
| ***F24F 13/02*** | (2006.01) |

(52) U.S. Cl.
CPC ..... *F24F 1/0033* (2013.01); *F24F 1/0059* (2013.01); *F24F 1/02* (2013.01); *F24F 13/0236* (2013.01)

(58) Field of Classification Search
CPC ..... F24F 1/0033; F24F 1/0059; F24F 1/02; F24F 13/0236; F24F 1/027; F24F 1/12; F24F 1/40
See application file for complete search history.

(56) References Cited

U.S. PATENT DOCUMENTS

| | | | | |
|---|---|---|---|---|
| 2,401,560 A * | 6/1946 | Graham | F24F 1/02 165/59 |
| 2,759,708 A * | 8/1956 | Burgess | F24F 3/001 165/231 |
| 2,764,341 A | 9/1956 | Greiner | |
| 2,939,297 A * | 6/1960 | Karger | F24F 1/02 62/298 |

(Continued)

FOREIGN PATENT DOCUMENTS

| | | |
|---|---|---|
| CA | 2615829 C | 3/2007 |
| CN | 101027523 A | 8/2007 |

(Continued)

OTHER PUBLICATIONS

Extended European Search Report; European Patent Application No. 19173578.6, dated Sep. 6, 2019 (8 pages).

(Continued)

*Primary Examiner* — Lionel Nouketcha
(74) *Attorney, Agent, or Firm* — Hamre, Schumann, Mueller & Larson, P.C.

(57) ABSTRACT

This disclosure relates generally to cabinets for commercial heating, ventilation, air conditioning and refrigeration (HVACR) systems. More particularly, this disclosure relates to HVACR cabinets including one or more plenum fans located in a fan box. The fan box may be located between an indoor coil and a heat exchanger compartment of an HVACR unit. The fan box may be configured to direct air into a heat exchanger compartment inlet. The fan box may be parallel with or angled with respect to the indoor coil.

15 Claims, 9 Drawing Sheets

(56) References Cited

U.S. PATENT DOCUMENTS

| | | | | | |
|---|---|---|---|---|---|
| 3,301,003 | A * | 1/1967 | Laing | F24F 1/02 | 62/324.5 |
| 3,398,880 | A | 8/1968 | Wallin | | |
| 3,404,539 | A | 10/1968 | Nikolaus | | |
| 3,743,010 | A | 7/1973 | Farney et al. | | |
| 3,878,886 | A * | 4/1975 | McIntire, Jr. | F24F 1/02 | 165/59 |
| 4,139,052 | A * | 2/1979 | Lackey | F24F 1/02 | 165/137 |
| 5,148,683 | A * | 9/1992 | Muller | F24F 1/0007 | 62/180 |
| 5,152,336 | A * | 10/1992 | Wollaber | F24F 1/027 | 165/122 |
| 5,335,721 | A * | 8/1994 | Wollaber | F24F 1/027 | 165/122 |
| 5,533,357 | A * | 7/1996 | Voorhis | F24F 1/027 | 62/277 |
| 6,336,338 | B1 * | 1/2002 | Koren | F24F 1/0003 | 62/262 |
| 7,305,844 | B2 * | 12/2007 | Cho | F24F 1/027 | 62/262 |
| 7,640,897 | B2 | 1/2010 | Gandrud et al. | | |
| 2003/0012649 | A1 | 1/2003 | Sakai et al. | | |
| 2008/0187433 | A1 | 8/2008 | Hopkins | | |
| 2009/0285669 | A1 | 11/2009 | Hopkins | | |
| 2011/0103957 | A1 | 5/2011 | Tang et al. | | |
| 2013/0056174 | A1 | 3/2013 | Ryu | | |
| 2017/0343239 | A1 | 11/2017 | Zunino | | |

FOREIGN PATENT DOCUMENTS

| | | | |
|---|---|---|---|
| CN | 106369689 | A | 2/2017 |
| CN | 106642457 | A | 5/2017 |
| DE | 102012000376 | A1 | 7/2013 |

OTHER PUBLICATIONS

Extended European Search Report; European Patent Application No. 19173578.6, dated Mar. 19, 2021 (4 pages).

* cited by examiner

HVACR SYSTEM INCLUDING MULTI-POSITIONAL AND MULTI-USE PLENUM FANS

FIELD

This disclosure relates generally to cabinets for commercial heating, ventilation, air conditioning and refrigeration (HVACR) systems. More particularly, this disclosure relates to HVACR cabinets including one or more plenum fans located in a fan box and the orientation of the fans relative to an indoor coil and a heat exchanger compartment.

BACKGROUND

Light commercial heating, ventilation, air conditioning and refrigeration (HVACR) systems drive air through the systems using one or more centrifugal blowers, particularly forward-curved scroll fans having logarithmic-type expansion housings. Single impeller fan units or arrays of multiple impeller fan units have been proposed as a replacement for centrifugal blowers in air handling units, with the arrays being mounted in place of the centrifugal blower, such as on a vertical wall within the air handling unit.

BRIEF SUMMARY

This disclosure relates generally to HVACR cabinets for commercial heating, ventilation, air conditioning and refrigeration (HVACR) systems. More particularly, this disclosure relates to HVACR cabinets including one or more plenum fans located in a fan box and the orientation of the fans relative to an indoor coil and a heat exchanger compartment. The fan box may be located between an indoor coil and a heat exchanger in the HVACR cabinet.

Using plenum fans located within a fan box reduces obstruction of the indoor coil typically caused by the centrifugal blower and improves airflow in the HVACR cabinet compared to HVACR cabinets using single centrifugal blowers. This improves efficiency for the fans. The reduced obstruction and more even flow also improves heat exchange between air in the HVACR system and the indoor coil.

Using a fan box to contain one or more plenum fans and position them within the HVACR cabinet efficiently uses space within the cabinet, to reduce cabinet length and accommodate the multiple plenum fans in the limited space available within the HVACR cabinet, particularly in light commercial applications, for example in the 3-ton to 25-ton capacity range, where space is particularly constrained. The locations and orientations of fan boxes in embodiments may eliminate the need to move or alter other components used within the HVACR cabinet, such as the indoor coil and the heat exchanger compartment while still accommodating the one or more plenum fans in place of a centrifugal blower.

In an embodiment, an HVACR cabinet includes an indoor coil, a heat exchanger compartment, a fan box located between the indoor coil and the heat exchanger compartment, the fan box including an inlet on an indoor coil side and an outlet on a heat exchanger compartment side, and one or more plenum fans mounted in the fan box.

In an embodiment, there are a plurality of plenum fans mounted in the fan box. In an embodiment, the plurality of plenum fans are arranged horizontally within the fan box. In an embodiment, the plurality of plenum fans are arranged vertically within the fan box.

In an embodiment, the plane of the inlet of the fan box is parallel to a plane of the indoor coil. In an embodiment, the plane of the inlet of the fan box is angled with respect to the plane of the indoor coil. In an embodiment, the plane of the inlet of the fan box is at an angle within a range of ±35° degrees with respect to a plane of the indoor coil.

In an embodiment, the heat exchanger compartment includes a heat exchanger compartment inlet opening, and the outlet of the fan box is configured to direct air towards the heat exchanger compartment inlet opening.

In an embodiment, the HVACR cabinet further includes a duct on a bottom of the HVACR cabinet, and the indoor coil is in a downflow duct orientation. In an embodiment, the HVACR cabinet further includes a duct on a side wall of the HVACR cabinet, and the indoor coil is in a horizontal duct orientation.

In an embodiment, the fan box is joined to a top of the HVACR cabinet and a wall of the heat exchanger compartment. In an embodiment, the fan box is joined to a side wall of the HVACR cabinet and a wall of the heat exchanger compartment.

In an embodiment, the one or more plenum fans are located entirely within the fan box.

In an embodiment, part of the fan box and part of the indoor coil overlap in a direction of a horizontal axis of the HVACR cabinet, and the part of the fan box is vertically above the part of the indoor coil.

In an embodiment, a method of directing airflow through an HVACR cabinet includes receiving air via a duct, drawing air into a fan box via one or more plenum fans in the fan box; and directing air from the fan box into a heat exchanger compartment. In this embodiment, the air passes through an indoor coil before entering the fan box, and the fan box is mounted in the HVACR cabinet between the indoor coil and the heat exchanger compartment.

DETAILED DESCRIPTION

This disclosure relates generally to HVACR cabinets for commercial heating, ventilation, air conditioning and refrigeration (HVACR) systems, for example in rooftop units and/or air handlers. More particularly, this disclosure relates to HVACR cabinets including one or more plenum fans located in a fan box.

Figure 1:
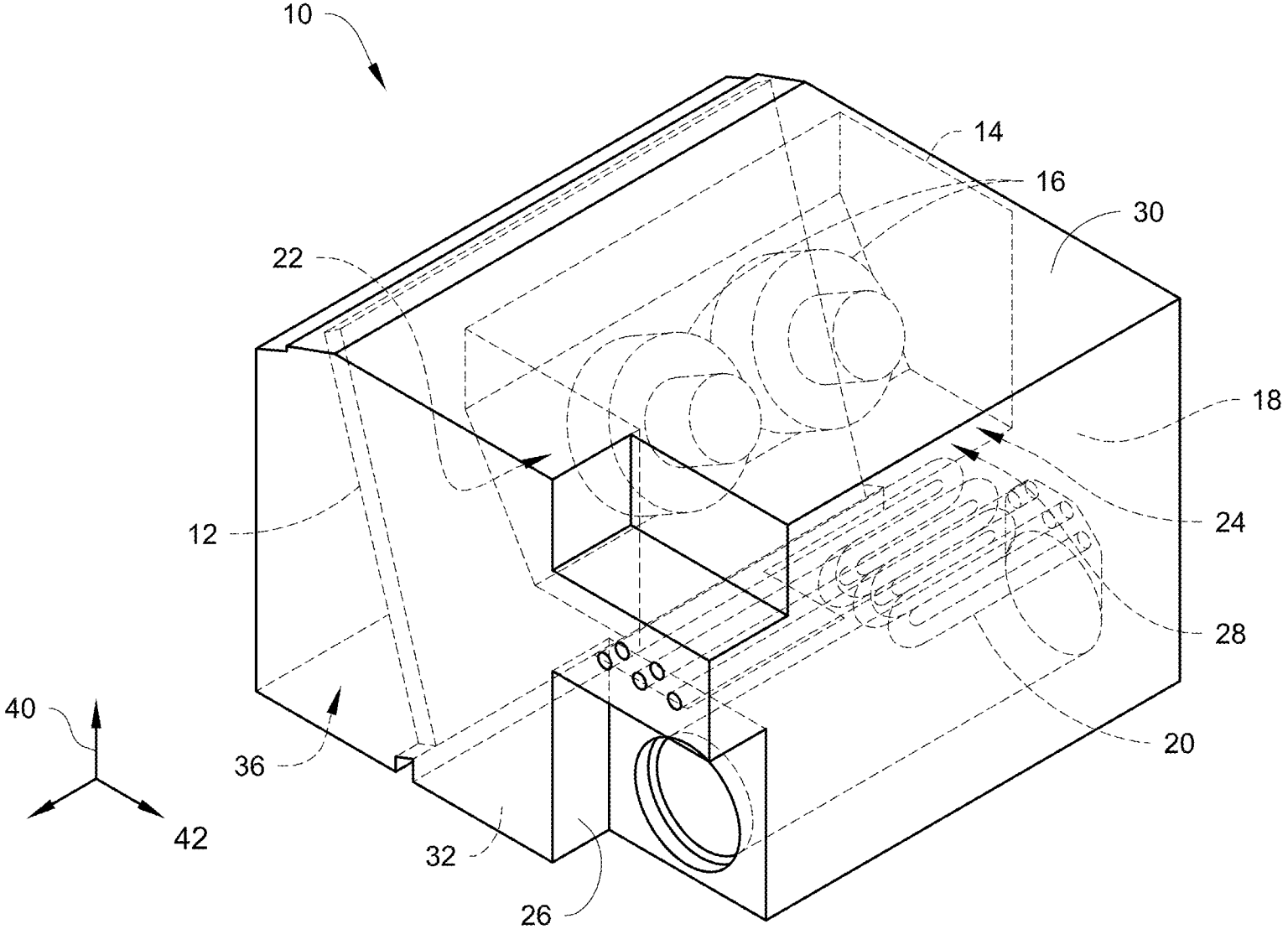
FIG. 1 shows an isometric view of an HVACR cabinet embodiment.

FIG. 1 shows an isometric view of an HVACR cabinet embodiment. HVACR cabinet 10 contains indoor coil 12, fan box 14, one or more plenum fans 16, and a heat exchanger compartment 18 including heat exchanger 20. Heat exchanger compartment 18 may be defined in part by a wall 26. HVACR cabinet 10 has a top 30 and a bottom 32. A duct 36 may be located on the bottom 32 of HVACR cabinet 10.

HVACR cabinet 10 is a part of an HVACR system where air handled by the system is heated or cooled by heat exchanger 20 or indoor coil 12, respectively. HVACR cabinet 10 may receive air from a building via return air inlet, and additional outdoor air may enter HVACR cabinet 10.

Indoor coil 12 is an indoor coil, for example the indoor coil of an air conditioner. Indoor coil 12 is part of a refrigerant circuit, and receives cooled refrigerant from the refrigerant circuit. When the air conditioner is used, air flowing through indoor coil 12 rejects heat to the refrigerant in indoor coil 12, cooling the air. Indoor coil 12 is oriented within HVACR cabinet 10 based on the position of the duct through which HVACR cabinet 10 receives air, for example a horizontal duct or a downflow duct. The face of indoor coil 12 may be inclined based on the orientation of indoor coil 12 within HVACR cabinet 10.

Fan box 14 supports one or more plenum fans 16 in a position between the indoor coil 12 and heat exchanger compartment 18. Fan box 14 includes fan box inlet 22 and fan box outlet 24. Fan box inlet 22 is in communication with the portion of HVACR cabinet 10 including indoor coil 12. Fan box outlet 24 is in communication with heat exchanger compartment 18, for example via heat exchanger compartment inlet 28. In an embodiment, fan box outlet 24 is in fluid communication the heat exchanger compartment inlet 28. In an embodiment, fan box outlet 24 is the same plane as heat exchanger compartment inlet 28. In an embodiment, the fan box outlet 24 is configured to direct airflow from the one or more plenum fans 16 towards the heat exchanger compartment inlet 28. In an embodiment, fan box 14 includes two plenum fans 16, the plenum fans 16 are 500-mm diameter plenum fans, and the fan box 14 is at or about 67 to at or about 70 inches in width. In an embodiment, fan box 14 contains a single 630-mm diameter plenum fan. Fan box 14 is made of a material of sufficient strength to support the one or more plenum fans 16, for example, but not limited to a suitable sheet metal, such as, but not limited to G90 sheet metal.

One or more plenum fans 16 are located in fan box 14. In the embodiment shown in FIG. 1, there are two plenum fans 16. Plenum fans 16 pressurize air in the fan box 14. In an embodiment, the plenum fans 16 are arranged vertically, with one plenum fan located above another in the vertical direction of HVACR cabinet 10. In the embodiment shown in FIG. 1, the plenum fans 16 are arranged horizontally, the plenum fans side-by-side in a width direction of HVACR cabinet 10.

In an embodiment, the plenum fans 16 are direct drive impeller fans. In an embodiment, the plenum fans 16 are backward-curved airfoil impellers. In an embodiment, the plenum fans 16 are driven by electric motors. In an embodiment, the electric motors driving plenum fans 16 are brushless electric motors. In an embodiment, the plenum fans 16 are controlled by variable-frequency drives (VFDs). In an embodiment, e.g. the embodiment shown in FIG. 7, the plenum fans 16 are positioned such that a motor axis 160 of each of the plenum fans 16 is parallel to the plane of inlet 28 of heat exchanger compartment 18.

In embodiments with multiple plenum fans 16 within fan box 14, each plenum fan 16 may have a different orientation, for example at least one plenum fan 16 may have an inlet having a plane parallel with the plane of indoor coil 12 while another plenum fan 16 has an inlet having a plane that is angled with respect to the plane of the indoor coil 12.

Heat exchanger compartment 18 is a portion of the HVACR cabinet 10 configured to contain a heat exchanger 20 and receive an airflow and then direct the airflow over the heat exchanger 20. Heat exchanger compartment 18 is defined in part by wall 26 dividing the heat exchanger compartment 18 from the rest of the inside of HVACR cabinet 10. Heat exchanger compartment wall 26 includes inlet 28, where air enter the heat exchanger compartment 18. In an embodiment, inlet 28 receives air from fan box 14 that has been pressurized by the one or more plenum fans 16. Heat exchanger compartment 18 contains heat exchanger 20. Heat exchanger 20 may be one or more tubes that, when the HVACR system is in a heating mode, reject heat to an airflow passing through heat exchanger compartment 18 to heat that airflow. The airflow leaving heat exchanger compartment 20 may then be distributed to one or more locations to heat or cool a structure.

Figure 2:
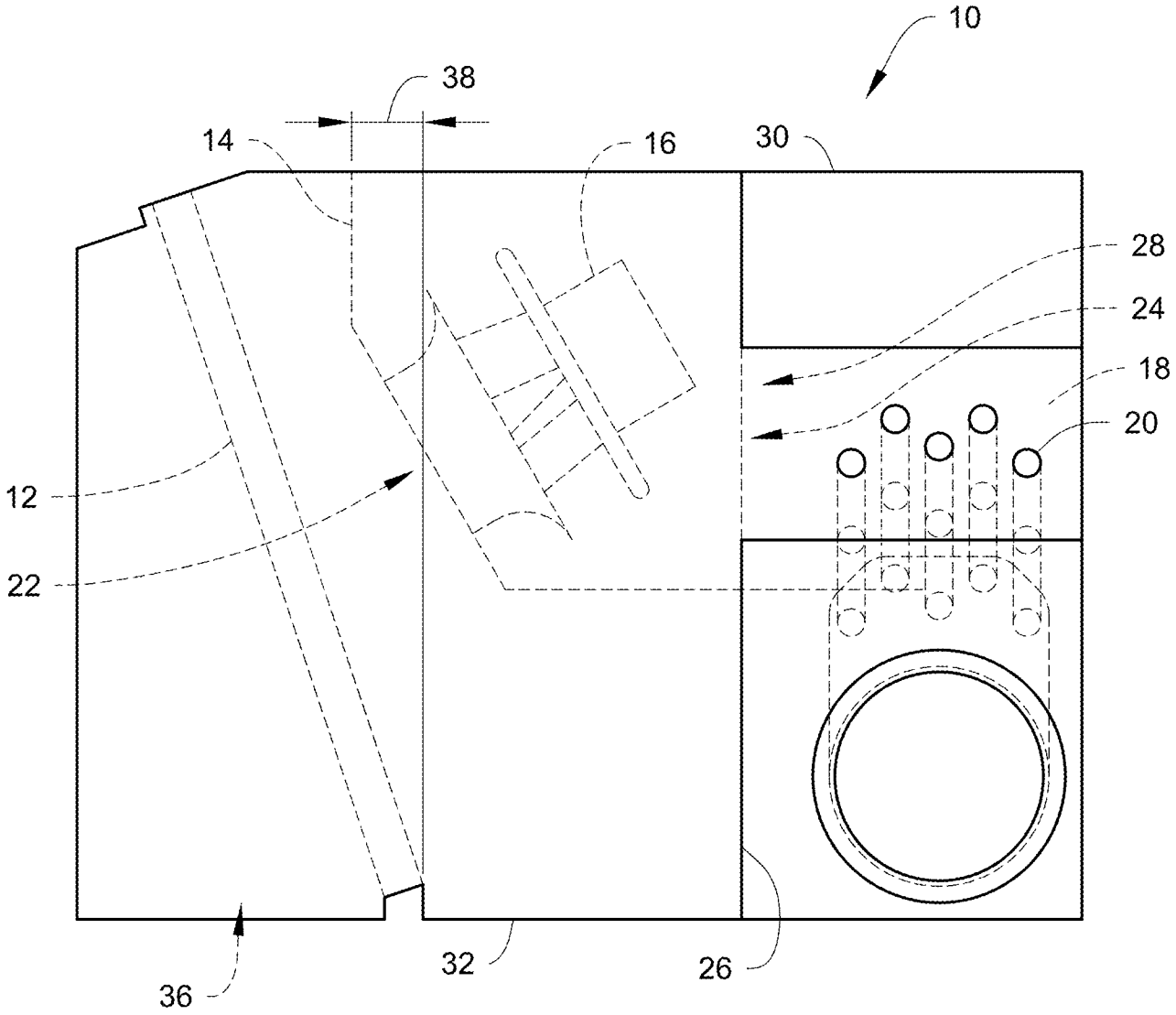
FIG. 2 shows a side view of the HVACR cabinet embodiment of FIG. 1.

FIG. 2 shows the embodiment of FIG. 1 viewed from a side of the HVACR cabinet 10. Indoor coil 12 is located within HVACR cabinet 10. In the embodiment shown in FIG. 2, indoor coil 12 is angled with respect to the vertical axis 40 (see FIG. 1) of HVACR cabinet 10. Indoor coil 12 is in the downflow orientation.

Fan box 14 is located between indoor coil 12 and heat exchanger compartment 18. In the embodiment shown in FIG. 2, fan box 14 is positioned such that outlet 24 of fan box 14 is at the inlet 28 of heat exchanger compartment 20. In the embodiment shown in FIG. 2, the plane of fan box inlet 22 is angled with respect to the plane of indoor coil 12. In another embodiment, the plane of fan box inlet 22 is parallel with the plane of indoor coil 12. In an embodiment, the angle between the plane of the indoor coil 12 and the plane of fan box inlet 22 is up to or at or about ±30 degrees. In an embodiment, the angle between the plane of the indoor coil 12 and the plane of fan box inlet 22 is up to or at or about ±35 degrees. In an embodiment, the angle between the plane of the indoor coil 12 and the plane of fan box inlet 22 is between at or about ±30 degrees and at or about ±35 degrees.

Figure 7:
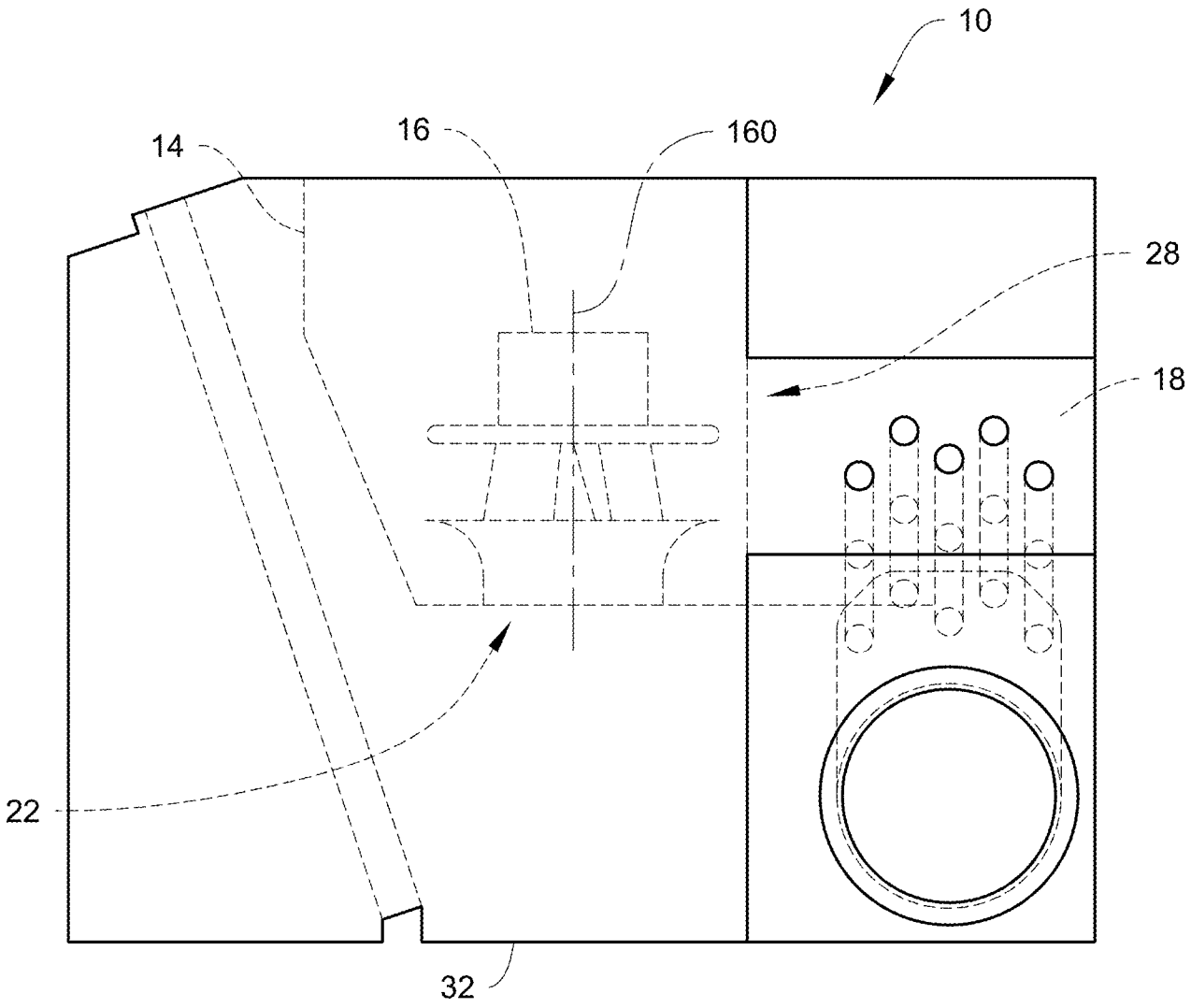
FIG. 7 shows an embodiment where the plane of the fan box inlet is parallel with a plane of the bottom of the HVACR cabinet.

In an embodiment shown in FIG. 7, the plane of the fan box inlet 22 is parallel with a plane of the bottom 32 of the HVACR cabinet 10. In this embodiment, the plenum fans 16 are positioned such that a motor axis 160 of each of the plenum fans 16 is parallel to the plane of inlet 28 of heat exchanger compartment 18.

Returning to the embodiment shown in FIG. 2, fan box 14 is connected to a top 30 of HVACR cabinet 10 and to a wall 26 of heat exchanger compartment 18. In the embodiment shown in FIG. 2, plenum fans 16 are located entirely within fan box 14, with the inlets of plenum fans 16 are at the fan box inlet 22. In an embodiment, the inlets of plenum fans 16 are recessed from the fan box inlet 22. In an embodiment, plenum fans 16 may extend from the fan box, for example, extending through fan box outlet 24. In the embodiment shown in FIG. 2, part of the fan box 14 and part of the indoor coil 12 overlap in a direction of a horizontal axis 42 (see FIG. 1) of the HVACR cabinet. The overlap of part of the fan box 14 and part of indoor coil 12 along the direction of horizontal axis 42 is overlap region 38. The overlap of part of the fan box 14 and part of the indoor coil 12 may be with respect to a particular direction, and may not be, for example, physical contact or interference of the fan box 14 and coil 12. The overlapping part of the fan box 14 is vertically above the overlapping part of the indoor coil 12 along vertical axis 40 (see FIG. 1).

Figure 3:
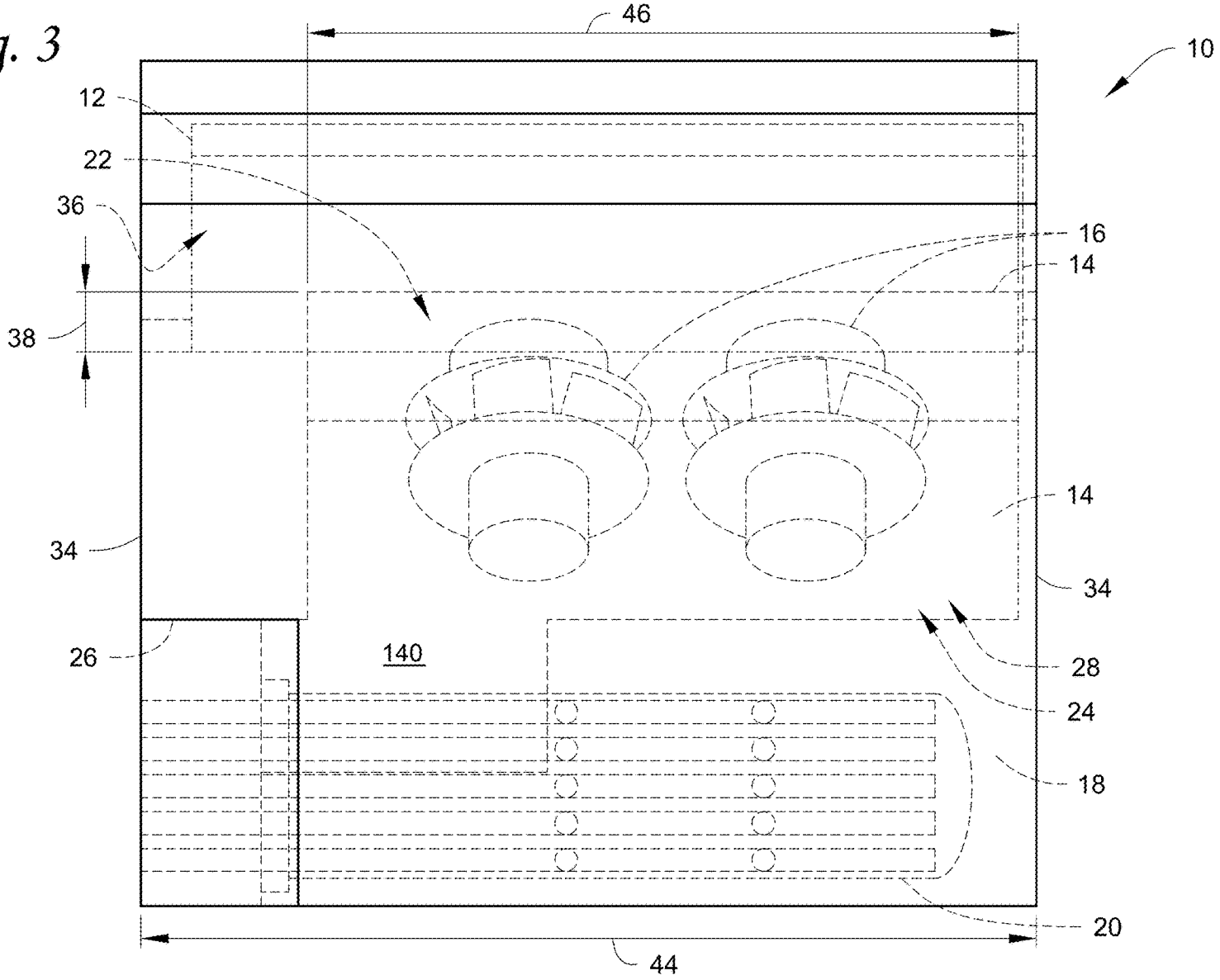
FIG. 3 shows a top view of the HVACR cabinet embodiment of FIG. 1.

FIG. 3 shows the embodiment of FIG. 1 viewed from the top of the HVACR cabinet 10. Overlap in overlap region 38 may be overlap along one axis of the HVACR cabinet 10, such as horizontal axis 42 (see FIG. 1). Even when there is overlap between fan box 14 and indoor coil 12 in one axis of the HVACR cabinet, fan box 14 and indoor coil 12 may be spaced apart such that they do not physically interfere with one another. For example, in other axes, such as vertical axis 40 (see FIG. 1), there may be a distance between fan box 14 and indoor coil 12. In the embodiment shown in FIG. 3, the part of fan box 14 in overlap region 38 is located vertically above the part of indoor coil 12 in overlap region 38. A guide vane 140 may be installed to direct air as it flows out of the fan box 14 and/or in to the heat exchanger compartment 18. In the embodiment shown in FIG. 3, fan box 14 has a width 46 that is less than the width 44 of HVACR cabinet 10. In FIG. 3, side walls 34 of the HVACR cabinet 10 are visible.

Figure 4:
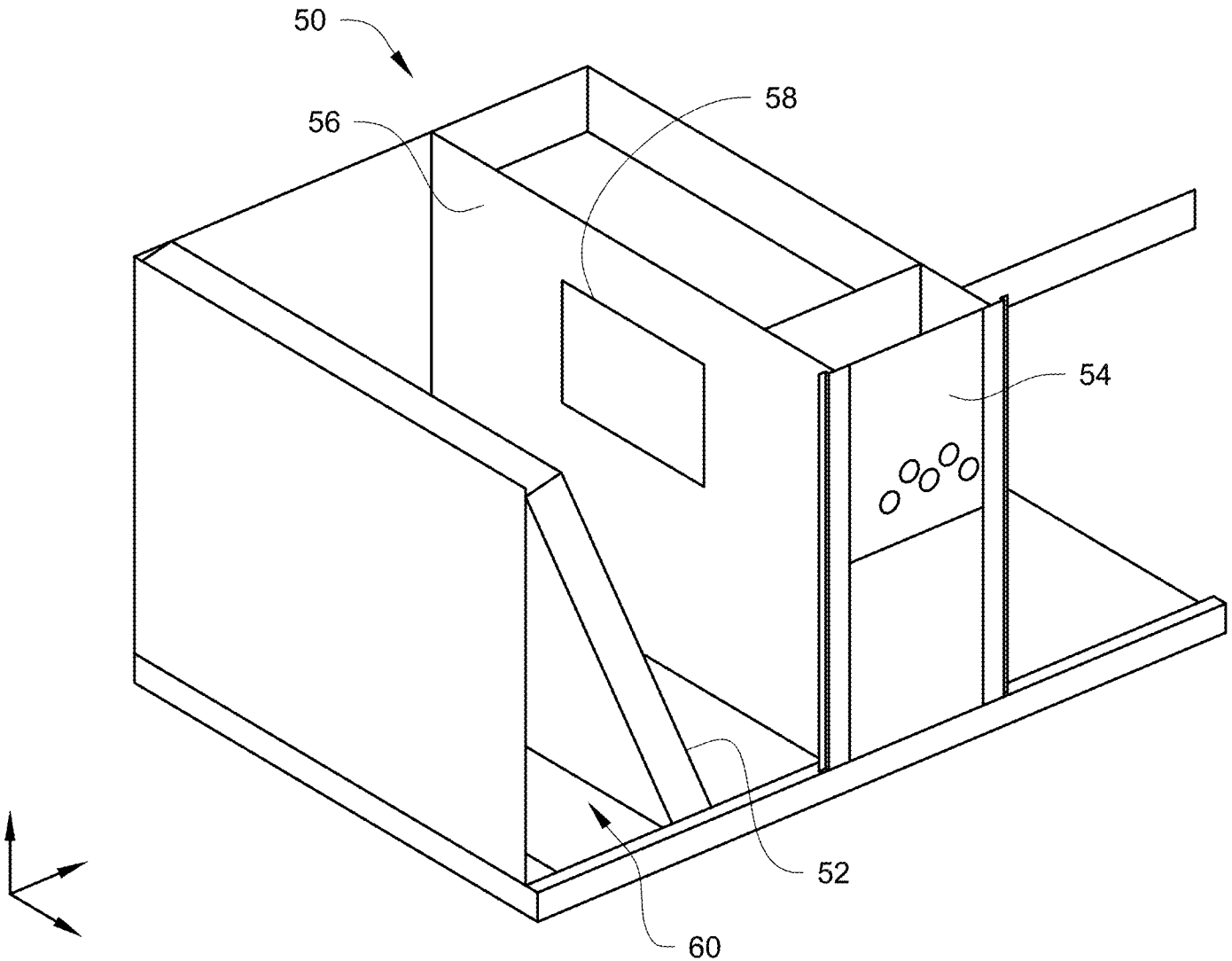
FIG. 4 shows an HVACR cabinet embodiment including an indoor coil that is tilted about a horizontal axis.

FIG. 4 shows an embodiment of an HVACR cabinet 50 that may accommodate a fan box. In the embodiment shown in FIG. 4, indoor coil 52 is in a downflow duct orientation, i.e. the indoor coil 52 is angled such that there is space for a duct 60 on the bottom of the HVACR cabinet 50, upstream of indoor coil 52 with respect to a direction of flow through the HVACR cabinet 50.

In the embodiment shown in FIG. 4, inlet 58 of heat exchanger compartment 54 is an opening on wall 56 of heat exchanger compartment 54. In the embodiment shown in FIG. 4, inlet 58 is positioned on wall 56 such that it is biased vertically towards the top of wall 56 relative to the bottom of wall 56. Portions of wall 56 surround inlet 58 on all sides. In an embodiment, inlet 58 is generally rectangular in shape. In an embodiment, inlet 58 is generally square in shape. In an embodiment, the inlet 58 may have a width and height greater than those shown in FIG. 4.

A fan box, such as fan box 14 shown in FIGS. 1-3 may be used with the embodiment shown in FIG. 4. A fan box used in the embodiment shown in FIG. 4 may include a plurality of plenum fans, such as plenum fans 16 shown in FIGS. 1-3, arranged in a horizontal orientation, with the fans located side-by-side in a horizontal direction of the HVACR cabinet 50. The fan box may be attached to a top of HVACR cabinet 50 and to the wall 56 of heat exchanger compartment 54. In an embodiment, the width and height of the inlet 58 may be up to a width and height of a fan box where it is attached to wall 56. In an embodiment, the fan box used with the embodiment of FIG. 4 may have a width that is less than the width of HVACR cabinet 50.

Figure 5A:
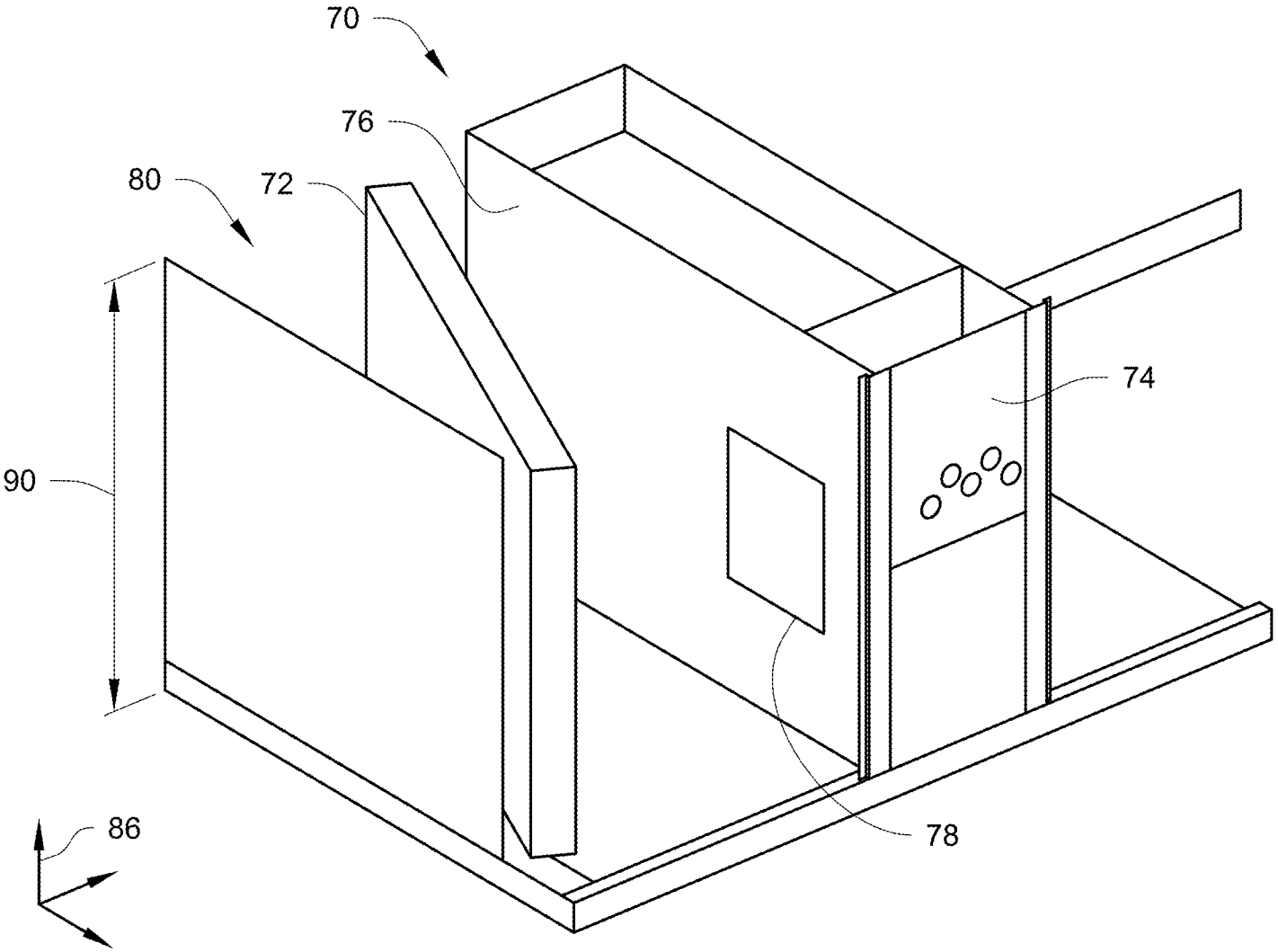
FIG. 5A shows an HVACR cabinet embodiment including an indoor coil that is tilted about a vertical axis.

FIG. 5A shows an embodiment of an HVACR cabinet 70. In the embodiment shown in FIG. 5, the indoor coil 72 is in a horizontal duct orientation, i.e. the indoor coil is angled within the HVACR cabinet 70 such that there is space 80 for a duct on a side of the HVACR cabinet 70 that is upstream of the indoor coil 72 with respect to a direction of flow through the HVACR cabinet 70.

Figure 5B:
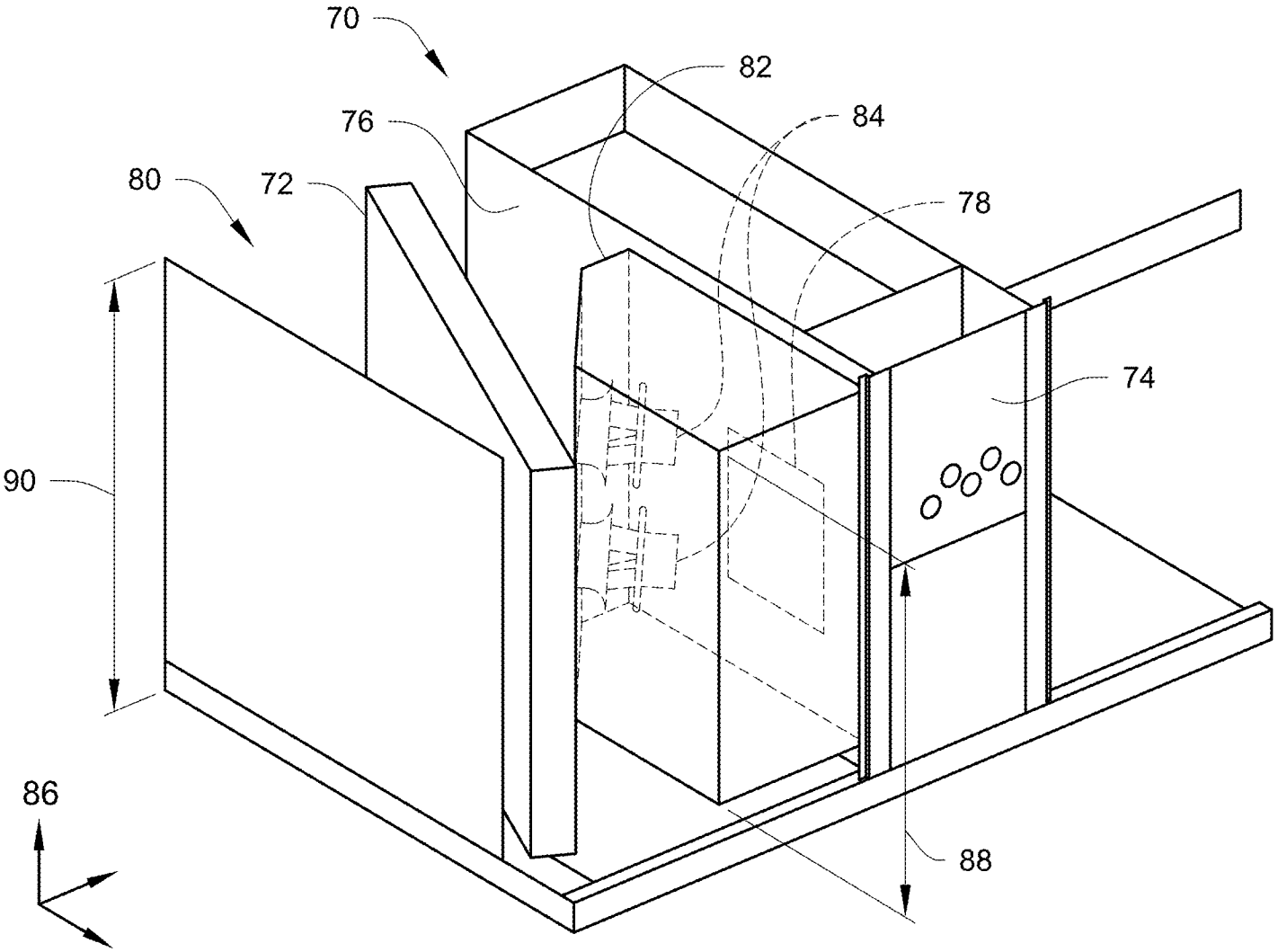
FIG. 5B shows the HVACR cabinet of FIG. 5A, further including a fan box according to an embodiment.

In the embodiment shown in FIG. 5A, inlet 78 of heat exchanger compartment 74 is an opening on wall 76 of heat exchanger compartment 74. In the embodiment shown in FIG. 5, inlet 78 is positioned biased horizontally along on wall 76, towards the side of HVACR cabinet 70 opposite the side of HVACR cabinet 70 having space 80 where a duct may be located in a wall of the HVACR cabinet 70. In an embodiment, the space 80 can correspond to where a wall would be located (see e.g. wall 30 in FIG. 1). In an embodiment, inlet 78 is surrounded on all sides by portions of wall 76 of heat exchanger compartment 74. In an embodiment, inlet 78 is generally rectangular in shape. In an embodiment, inlet 78 is generally square in shape. In an embodiment, inlet 78 may have a height and/or a width greater than that shown in FIGS. 5A and 5B FIG. 5B shows the HVACR cabinet of FIG. 5A, further including a fan box 82 according to an embodiment. In the embodiment shown in FIG. 5B, fan box 82 includes a plurality of plenum fans 84. Plenum fans 84 are positioned in a vertical orientation within the fan box, and the fans 84 located above one another in a vertical direction 86 (see also FIG. 5A) of the HVACR cabinet 70. Plenum fans 84 may be, for example, backward-curved airfoil impellers. The fan box 82 may be attached to a wall of HVACR cabinet 70 opposite the side of HVACR cabinet 70 having space 80 for a duct and to the wall 76 of heat exchanger compartment 74. In an embodiment, the width and height of the inlet 78 may be up to a width and height of fan box 82 where it is attached to wall 76. In an embodiment, the fan box 82 may have a height 88 that is less than the height 90 of HVACR cabinet 70.

Figure 6A:
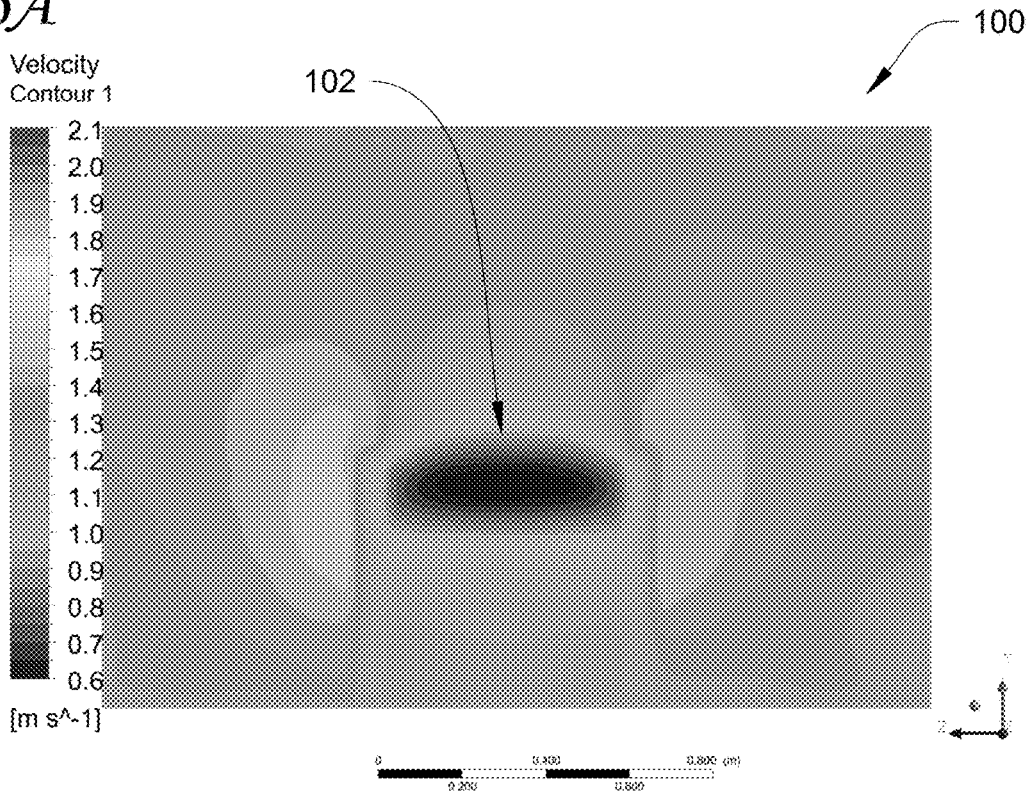
FIG. 6A shows the distribution of airflow across the indoor coil of an HVACR cabinet having a forward-curved scroll fan.
Figure 6B:
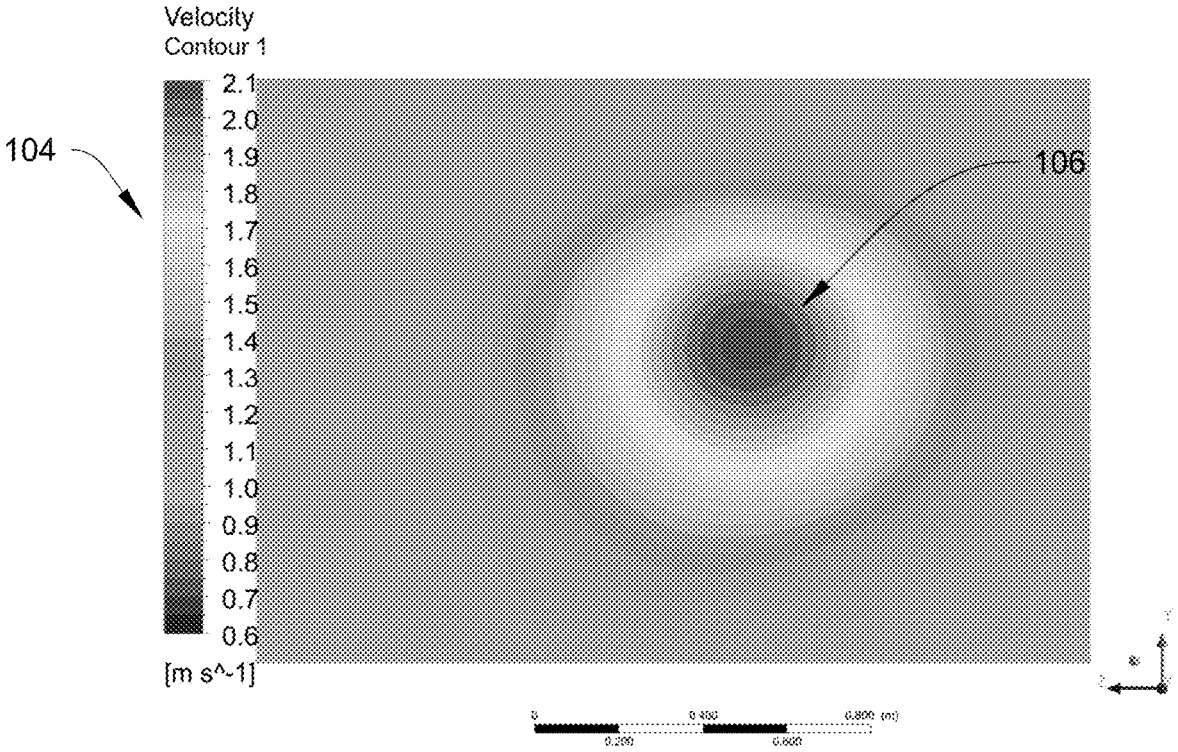
FIG. 6B shows distribution of flow across the indoor coil of an HVACR cabinet embodiment having one 630-mm diameter plenum fan located in a fan box.
Figure 6C:
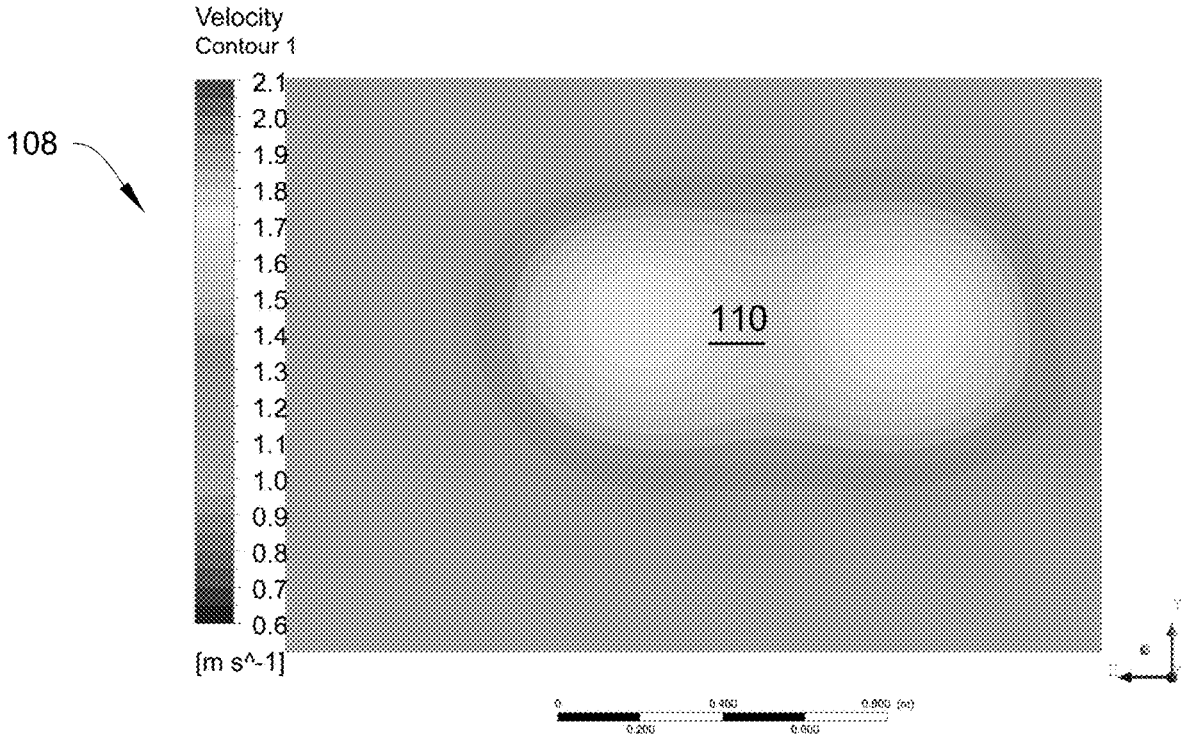
FIG. 6C shows the distribution of flow across the indoor coil of an HVACR cabinet embodiment having two 500-mm diameter plenum fans located in a fan box.

FIG. 6A shows the distribution of airflow across the indoor coil of an HVACR cabinet having a forward-curved scroll fan. FIG. 6B shows distribution of airflow across the indoor coil of an HVACR cabinet embodiment having one 630-mm diameter plenum fan located in a fan box. FIG. 6C shows the distribution of airflow across the indoor coil of an HVACR cabinet embodiment having two 500-mm diameter plenum fans located in a fan box.

In distribution of airflow 100 across the indoor coil of an HVACR cabinet having a forward-curved scroll fan shown in FIG. 6A, the area 102 corresponding to the position of forward-curved scroll fan has a significantly lower rate of flow due to the obstruction provided by the centrifugal blower within the HVACR cabinet.

In the distribution of airflow 104 across the indoor coil of an HVACR cabinet embodiment having one 630-mm diameter plenum fan located in a fan box shown in FIG. 6B, the flow is more consistent across the face of the indoor coil. Since there is not a low flow area such as area 102, the overall flow rates are lower over most of the indoor coil. This more consistent flow improves the efficiency of heat transfer from the air being conditioned to the indoor coil during cooling operations of the HVACR system. The lack of a "dead zone" such as area 102 in embodiments with one or more plenum fans located in a fan box and the lower flow rates through the other portions of the indoor coil allow flow through the HVACR cabinet to be achieved more efficiently. Further, reducing obstruction of the airflow through indoor coil improves the refrigeration capacity of the unit. However, there is now an area 106 having elevated velocity of airflow across the indoor coil, the position of area 106 corresponding to the location of the 630-mm plenum fan.

In the distribution of airflow 108 across the indoor coil of an HVACR cabinet embodiment having two 500-mm diameter plenum fans located in a fan box shown in FIG. 6C, the flow is more consistent across the indoor coil than even in flow across the indoor coil 104 shown in FIG. 6B. The area of elevated velocity across the indoor coil 106 is not present or is less pronounced in distribution of airflow 108. Distribution of airflow 108 includes an area 110 of increased velocity through the indoor coil. The velocity of airflow through area 110 in distribution of airflow 108 is reduced in comparison with area 106 in distribution of airflow 104. The more consistent flow provides even greater efficiency improvements and refrigeration capacity improvements than the embodiment shown in FIG. 6B.

Aspects:

It is understood that any of aspects 1-13 may be combined with any of aspects 14-19.

Aspect 1. An HVACR cabinet, comprising:

an indoor coil;

a heat exchanger compartment;

a fan box, located between the indoor coil and the heat exchanger compartment, including an inlet on an indoor coil side and an outlet on a heat exchanger compartment side; and one or more plenum fans mounted in the fan box.

Aspect 2. The HVACR cabinet according to aspect 1, wherein the one or more plenum fans are a plurality of plenum fans arranged vertically within the fan box.

Aspect 3. The HVACR cabinet according to any of aspects 1-2, wherein the one or more plenum fans are a plurality of plenum fans arranged horizontally within the fan box.

Aspect 4. The HVACR cabinet according to any of aspects 1-3, wherein a plane of the inlet of fan box is parallel with a plane of the indoor coil.

Aspect 5. The HVACR cabinet according to any of aspects 1-4, wherein a plane of the inlet of the fan box is angled with respect to a plane of the indoor coil.

Aspect 6. The HVACR cabinet according to aspect 5, wherein the plane of the inlet of the fan box is at an angle within a range of ±35° degrees with respect to a plane of the indoor coil.

Aspect 7. The HVACR cabinet according to any of aspects 1-6, wherein heat exchanger compartment includes a heat exchanger compartment inlet opening, and the outlet of the fan box is configured to direct air towards the heat exchanger compartment inlet opening.

Aspect 8. The HVACR cabinet according to any of aspects 1-7, further comprising a duct on a bottom of the HVACR cabinet and wherein the indoor coil is in a downflow duct orientation.

Aspect 9. The HVACR cabinet according to any of aspects 1-7, further comprising a duct on a side wall of the HVACR cabinet and wherein the indoor coil is in a horizontal duct orientation.

Aspect 10. The HVACR cabinet according to any of aspects 1-9, wherein the fan box is joined to a top of the HVACR cabinet and a wall of the heat exchanger compartment.

Aspect 11. The HVACR cabinet according to any of aspects 1-10, wherein the fan box is joined to a side wall of the HVACR cabinet and a wall of the heat exchanger compartment.

Aspect 12. The HVACR cabinet according to any of aspects 1-11, wherein the one or more plenum fans are located entirely within the fan box.

Aspect 13. The HVACR cabinet according to any of aspects 1-12, wherein part of the fan box and part of the indoor coil overlap in a direction of a horizontal axis of the HVACR cabinet, and the part of the fan box is vertically above the part of the indoor coil.

Aspect 14. A method of directing airflow through an HVACR cabinet, comprising:

receiving air via a duct;

drawing air into a fan box via one or more plenum fans in the fan box; and directing air from the fan box into a heat exchanger compartment, wherein the air passes through an indoor coil before entering the fan box, and the fan box is mounted in the HVACR cabinet between the indoor coil and the heat exchanger compartment.

Aspect 15. The method according to aspect 14, wherein the duct is located on a bottom of the HVACR cabinet, the indoor coil is in a downflow duct orientation, and the one or more plenum fans are a plurality of plenum fans arranged horizontally.

Aspect 16. The method according to any of aspects 14-15, wherein the duct is located on a side wall of the HVACR cabinet and the indoor coil is in a horizontal duct orientation, and the one or more plenum fans are a plurality of plenum fans arranged vertically.

Aspect 17. The method of any of aspects 14-16, wherein a plane of an inlet of fan box is parallel with a plane of the indoor coil.

Aspect 18. The method according to any of aspects 14-17, wherein a plane of an inlet of the fan box is angled with respect to a plane of the indoor coil.

Aspect 19. The method according to aspect 18, wherein the plane of an inlet of the fan box is at an angle within a range of ±35° degrees with respect to a plane of the indoor coil.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heating, ventilation, air conditioning, and refrigeration (HVACR) cabinet, comprising:

a duct configured to provide return air from a building, the duct provided on a bottom of the HVACR cabinet;

an indoor coil of an HVACR system configured to cool air flowing through the indoor coil, the air including the return air;

a heat exchanger compartment configured to contain one or more tubes that, when the HVACR system is in a heating mode, reject heat to an airflow passing through heat exchanger compartment, the heat exchanger compartment defined in part by a wall, the wall having a heat exchanger compartment inlet;

a fan box, located between the indoor coil and the heat exchanger compartment with respect to a direction of a horizontal axis of the HVACR cabinet, the fan box including an inlet on an indoor coil side and an outlet on a heat exchanger compartment side, the outlet in fluid communication with the heat exchanger compartment inlet; and a plurality of plenum fans mounted in the fan box, each plenum fan of the plurality of plenum fans having a motor axis perpendicular to a plane of the inlet of the fan box, each plenum fan of the plurality of plenum fans configured to draw air through the inlet of the fan box on the indoor coil side to pressurize the fan box, wherein the indoor coil is located between the duct and the fan box with respect to a flow of air through the HVACR cabinet, the indoor coil angled such that the indoor coil at least partially overlaps with a position of the duct in the direction of the horizontal axis of the HVACR cabinet, the fan box connected to a top of the HVACR cabinet, part of the fan box and part of the indoor coil overlap in the direction of the horizontal axis of the HVACR cabinet, and the part of the fan box is vertically above the part of the indoor coil.

2. The HVACR cabinet of claim 1, wherein the plurality of plenum fans are arranged vertically within the fan box.

3. The HVACR cabinet of claim 1, wherein the plurality of plenum fans are arranged horizontally within the fan box.

4. The HVACR cabinet of claim 1, wherein the plane of the inlet of the fan box is parallel with a plane of the indoor coil.

5. The HVACR cabinet of claim 1, wherein the plane of the inlet of the fan box is angled with respect to a plane of the indoor coil.

6. The HVACR cabinet of claim 5, wherein the plane of the inlet of the fan box is at an angle within a range of ±35° degrees with respect to the plane of the indoor coil.

7. The HVACR cabinet of claim 1, wherein the outlet of the fan box is configured to direct air towards the heat exchanger compartment inlet.

8. The HVACR cabinet of claim 1, wherein the indoor coil is in a downflow duct orientation.

9. The HVACR cabinet of claim 1, wherein the fan box is joined to a side wall of the HVACR cabinet and a wall of the heat exchanger compartment.

10. The HVACR cabinet of claim 1, wherein each plenum fan of the plurality of plenum fans is located entirely within the fan box.

11. A method of directing airflow through a heating, ventilation, air conditioning, and refrigeration (HVACR) cabinet, comprising:

receiving return air from a building air via a duct, the duct provided on a bottom of the HVACR cabinet;

drawing air including the return air through an inlet into a fan box via a plurality of plenum fans in the fan box; and directing air from the fan box into a heat exchanger compartment, the heat exchanger compartment defined in part by a wall, the wall having a heat exchanger compartment inlet, wherein the air passes through an indoor coil, the indoor coil located between the duct and the fan box, prior to the air being drawn through the inlet into the fan box by the plurality of plenum fans, and the fan box is mounted in the HVACR cabinet between the indoor coil and the heat exchanger compartment inlet with respect to a direction of a horizontal axis of the HVACR cabinet, each plenum fan of the plurality of plenum fans has a motor axis perpendicular to a plane of the inlet of the fan box, the fan box is connected to a top of the HVACR cabinet, the indoor coil is angled such that the indoor coil at least partially overlaps with a position of the duct in a direction of a horizontal axis of the HVACR cabinet, and part of the fan box and part of the indoor coil overlap in a direction of a horizontal axis of the HVACR cabinet, and the part of the fan box is vertically above the part of the indoor coil.

12. The method of claim 11, wherein the indoor coil is in a downflow duct orientation, and the plurality of plenum fans are arranged horizontally.

13. The method of claim 11, wherein the plane of the inlet of the fan box is parallel with a plane of the indoor coil.

14. The method of claim 11, wherein the plane of the inlet of the fan box is angled with respect to a plane of the indoor coil.

15. The method of claim 14, wherein the plane of the inlet of the fan box is at an angle within a range of ±35° degrees with respect to the plane of the indoor coil.

* * * * *